United States Patent [19]

Harders

[11] 3,998,063

[45] Dec. 21, 1976

[54] METHOD AND APPARATUS FOR REMOVING CONSTRUCTION PILES

[76] Inventor: Holton G. Harders, 5521 E. Highway 98, Panama City, Fla. 32401

[22] Filed: Feb. 17, 1976

[21] Appl. No.: 658,278

[52] U.S. Cl. ..... 61/53; 61/53.66

[51] Int. Cl.[2] ..... E02D 5/22

[58] Field of Search ..... 61/53.5, 53.66, 53.64, 61/53.6; 173/49

[56] References Cited

UNITED STATES PATENTS

| | | | |
|---|---|---|---|
| 3,394,766 | 7/1968 | Lebelle | 173/49 |
| 3,530,947 | 9/1970 | Gendron | 61/53.5 X |
| 3,543,525 | 12/1970 | Phares | 61/53.66 |
| 3,550,694 | 12/1970 | Gawlik | 173/49 X |
| 3,828,864 | 8/1974 | Haverkamp et al. | 61/53.5 X |
| 3,920,083 | 11/1975 | Makita | 61/53.5 X |

FOREIGN PATENTS OR APPLICATIONS

| | | | |
|---|---|---|---|
| 1,484,509 | 9/1969 | Germany | 61/53.5 |
| 1,175,520 | 12/1969 | United Kingdom | 61/53.5 |

*Primary Examiner*—Dennis L. Taylor
*Attorney, Agent, or Firm*—William E. Mouzavires

[57] ABSTRACT

Method and apparatus for removing construction piles in which a clamp mounted in a hollow head grips opposite sides of a pile, and the head is vibrated vertically by means of a vibrating hammer which is clamped to the head so that the head moves up and down as a unit with the hammer to loosen the pile. The vibrating hammer is suspended from a crane cable which, after loosening the pile, is raised to easily remove the pile. In commercial situations where many piles are to be removed from one area, it is preferred that the present invention be used to loosen the piles, leaving complete withdrawal of the piles to a conventional choker operated by a second crane which follows the first crane carrying the vibrating hammer and clamping head of the present invention.

In one embodiment, the clamp head includes a generally hollow steel casing movable over the top of the pile to a point limited by a horizontal plate fixed across a top portion of the casing. A pair of clamping shoes are provided in the casing below the top plate to grip opposite sides of the pile. One of the shoes is movable across the casing towards and away from a fixed shoe, preferably by a hydraulic jack or fluid motor that may be powered from any suitable source. To guide the movable shoe, a pair of anchor bars are fixed across the casing to slidably receive the movable shoe and maintain it accurately aligned with the fixed shoe as well as to transmit forces from the pile to the steel casing of the clamp head.

17 Claims, 7 Drawing Figures

METHOD AND APPARATUS FOR REMOVING CONSTRUCTION PILES

BACKGROUND OF INVENTION

The use of piles for foundations and other basic support in construction has of course been known for centuries. While effective methods have been known and used for driving piles over the years, of recent times a real problem has developed in areas of reconstruction, redevelopment or site clearing in removing wood or concrete piles in a manner which is feasible and not prohibitive on a commercial cost basis. Most if not all present and past methods of removing such piles have attempted to remove them by application of straight upward forces to the pile. This method is too expensive and time consuming and in many cases, simply not effective to loosen the pile.

OBJECTS OF THE PRESENT INVENTION

It is an object of the present invention to provide novel and improved method and apparatus for loosening and removing piles. While particularly useful in removing wood or concrete piles, the present invention may also be used to drive piles, if desired.

Another object of the present invention is to provide novel method and apparatus which will effectively remove construction piles in a highly efficient manner suitable for use in commercial projects such as site clearing, redevelopment or reconstruction. Included herein is the provision of such method and apparatus which may be used to remove piles in a manner which is commercially feasible from the standpoints of equipment, cost, workman skill and safety.

Another object of the present invention is to provide such method and apparatus which may be utilized to remove piles regardless of the size of the piles or the material from which the piles are made and further regardless of whether the piles are on land or underwater.

SUMMARY OF INVENTION

The method of the present invention is utilized to remove construction piles of wood or concrete by imparting up and down forces to the pile to loosen the pile for removal. The method employs a clamp mounted in a hollow cylindrical head to grip the opposite sides of a pile with great force after which the clamp head is vibrated vertically by means of a vibrating hammer which is clamped to the head so that the head moves up and down as a unit with the hammer to loosen the pile. The vibrating hammer is suspended from a crane cable which, after loosening the pile by imparting up and down vertical forces to the pile, is raised to easily remove the pile. In commercial situations where many piles are to be removed from a given area, it is preferred that the clamp head of the present invention be used to only loosen the piles, leaving complete withdrawal of the piles to a conventional choker operated by a second crane which follows the first crane carrying the vibrating hammer and clamping head.

Briefly described, preferred apparatus embodying the clamp head of the present invention includes a generally hollow steel casing movable axially over the top of the pile to a point limited by a horizontal plate fixed across a top portion of the casing to thus initially install the clamp head on the pile. A pair of clamping shoes are provided in the casing below the top plate to grip opposite sides of the pile. One of the shoes is movable across the casing towards and away from a fixed shoe by a portable motor, preferably a hydraulic jack or other fluid motor that may be powered from any suitable source. To guide the movable shoe, a pair of anchor bars are fixed across the casing to slidably receive the movable shoe and maintain it accurately aligned with the fixed shoe. The anchor bars also importantly serve to receive and distribute the forces imparted to the movable shoe during operation on the pile.

When conventional wood piles are to be removed, the shoes are formed with concave gripping surfaces conforming to the cylindrical surfaces of the wood pile. In addition, the contacting surfaces of the gripping shoes are provided with corrugations, ridges or other roughening means such as steel or other metallic bars fixed to the gripping surfaces of the shoes to enhance gripping engagement with the pile. When conventional concrete piles conventionally formed with flat surfaces are to ve removed, the shoes are formed with flat pile containing surfaces conforming to the flat surfaces of the concrete pile.

The motor for operating the movable shoe is detachably mounted to the casing to permit it to be relocated along the casing or to be removed and replaced. For certain operations, the casing may be enlarged or elongated to accommodate additional pairs of gripping shoes or to increase the range over the length of the casing in which the shoes may be relocated, for example, when it is desired to grip the pile at a certain portion where the wood is sufficiently strong to receive the great gripping force imparted to the pile by the gripping shoes.

DRAWINGS

The above and other objects of the present invention will become apparent from the following more detailed description taken in conjunction with the drawings in which.

DETAILED DESCRIPTION

Figure 1:
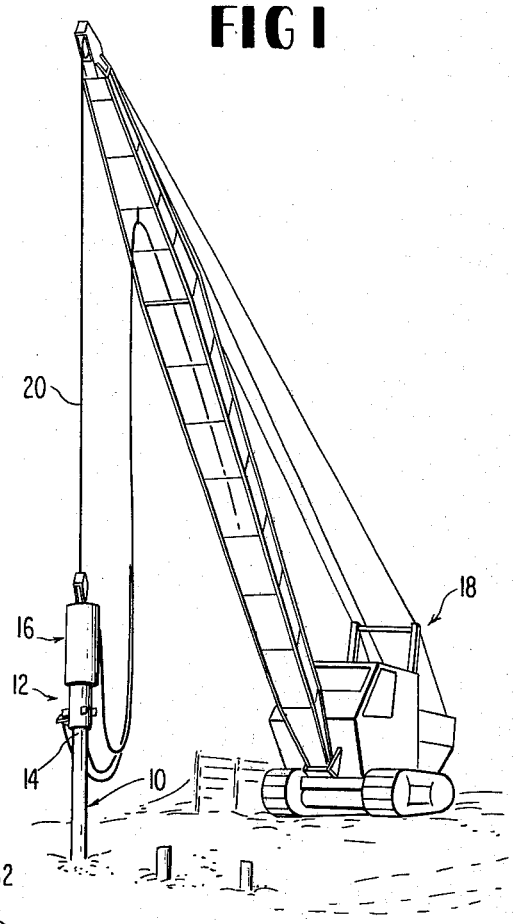
FIG. 1 is a perspective view of a crane having suspended therefrom a vibrating hammer and clamp head for removing a pile in accordance with the present invention.
Figure 2:
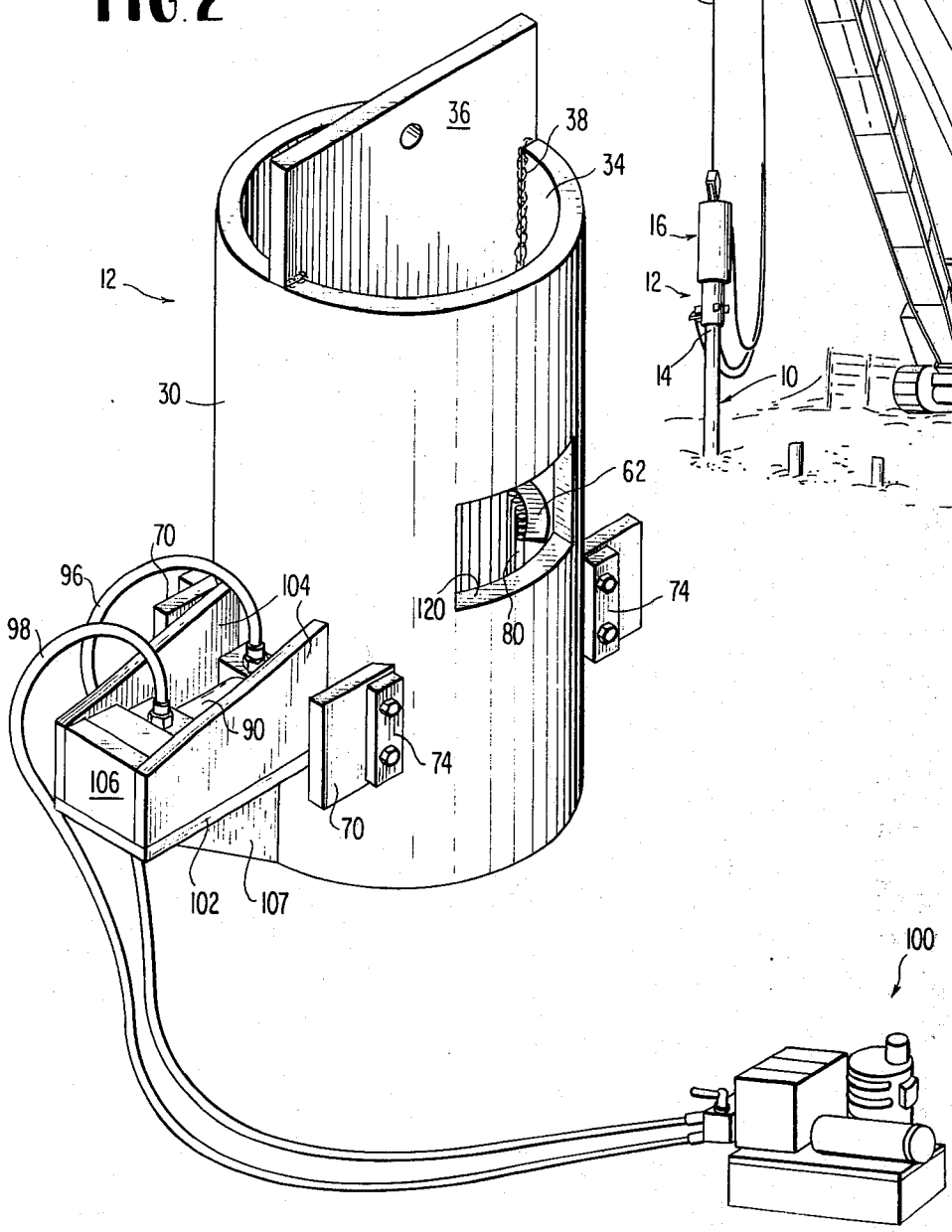
FIG. 2 is a perspective view of a clamp head embodying one of the aspects of the present invention.
Figure 3:
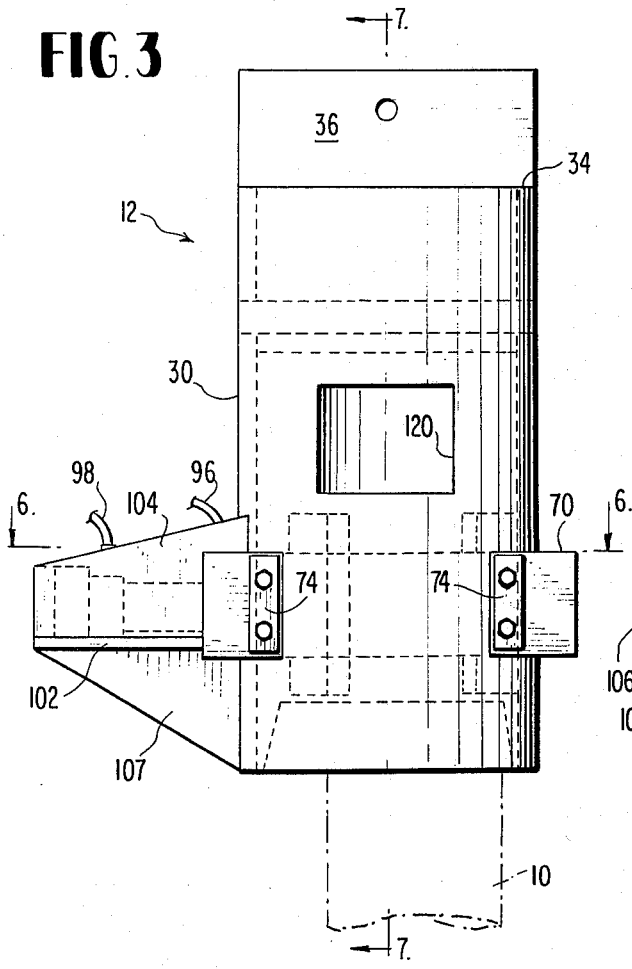
FIG. 3 is an elevational view as seen generally from the right-hand side of FIG. 2.

Referring now to the drawings in detail, there is shown in FIG. 1 for illustrative purposes only, method and apparatus for removing construction piles, one such pile being generally designated 10. According to the method aspect of the present invention, a clamp head generally designated 12 is lowered over the top 14 of the pile to firmly grip the pile with immense pressure. A vibrating hammer generally designated 16 which is removably fixed, such as by clamping, to the top of clamp head 12, is vibrated up and down in vertical motion. Because vibrating hammer 16 is securely fixed to clamp head 12, and the latter firmly grips the pile, the pile moves up and down with the vibrating hammer and is thus easily loosened.

Prior to operation of the vibrating hammer, the pile is gripped by clamp head 12 with sufficient force to prevent slippage when the pile is subjected to the vertical force of the vibrating hammer. For example, when removing an 18 inch diameter wood pile embedded for a depth over 60 feet, a gripping force of 6000 pounds has been found to be more than sufficient when using a 5½ ton vibrating hammer having a capacity of 140,000 pounds dynamic force and a frequency or amplitude of 15000–18500 CPMS.

Any conventional, commercially available vibrating hammer 16 may be employed in carrying out the present invention. However, it should be understood that electrically driven vibrating hammers or other vibrating devices of sufficient force capacity may be employed as long as they are capable of being securely fixed to the top of clamp head 12 so that the vibrating hammer and clamp head 12 move as a unit together with the pile 10 which is firmly gripped by clamp head 12.

During the above operation and prior thereto when clamp head 12 is being placed on top 14 of pile 10, vibrating hammer 16 and clamp 12 are held only by a vertical cable 20 of a crane generally designated 18. After the pile is loosened, it may be removed by raising crane cable 20.

In situations where many piles are to be removed from a given area in one operation, it is preferred that the present invention be used to just loosen each pile after which clamp head 12 is released from the pile, and the entire assembly of clamp head 12 and vibrating hammer 16 is moved to the next pile to be loosened by appropriate manipulation of crane cable 20 and movement of crane 18. The pile which has just loosened is then entirely removed by means of a second crane (not shown) which follows and effects removal by any conventional method such as by application of a choker (not shown) to the pile which grips the pile and then raising the choker by means of the second crane and its cable. In this way, the overall operation does not have to be interrupted for any appreciable time but instead, the operation of loosening and removing piles continues through the use of two cranes.

CLAMP HEAD 12

Figure 5:
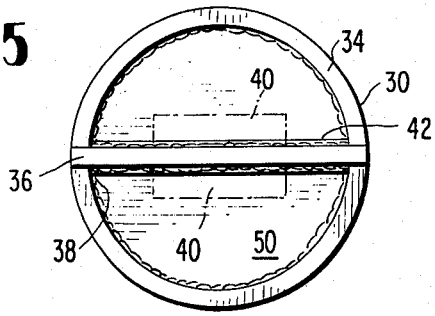
FIG. 5 is a top view of the clamp head but with certain parts omitted.

In the preferred embodiment of the present invention, clamp head 12 includes a steel cylindrical casing 30 having a lower open end 32 for receiving the top portion 14 of pile 10, and an upper end 34 having fixed therein in a vertical plane, a coupling plate 36 for securing vibrating hammer 16 to casing 30 as will be described. In one embodiment, casing 30 is approximately eight feet long, thirty-two inches in diameter and has a thickness of one and one-half inches. Coupling plage 36 which may be one and one-half inches thick plate steel, extends vertically within top end 34 of the casing where it is welded along recessed side portions 38 to the casing at diametrically opposed locations on the casing. As shown in the drawings, coupling plate 36 has a portion projecting beyond the top end 34 of casing 30 providing opposite gripping services that are to be gripped by jaws 40 (see FIG. 5) of vibrating hammer 16.

Figure 4:
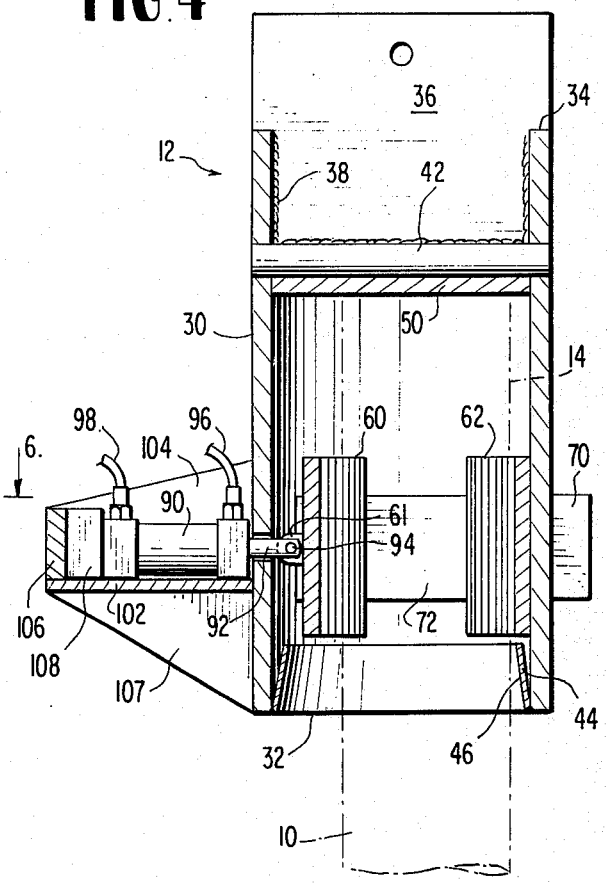
FIG. 4 is a longitudinal cross-sectional view of the clamp head when viewed in the same direction as in FIG. 3.
Figure 7:
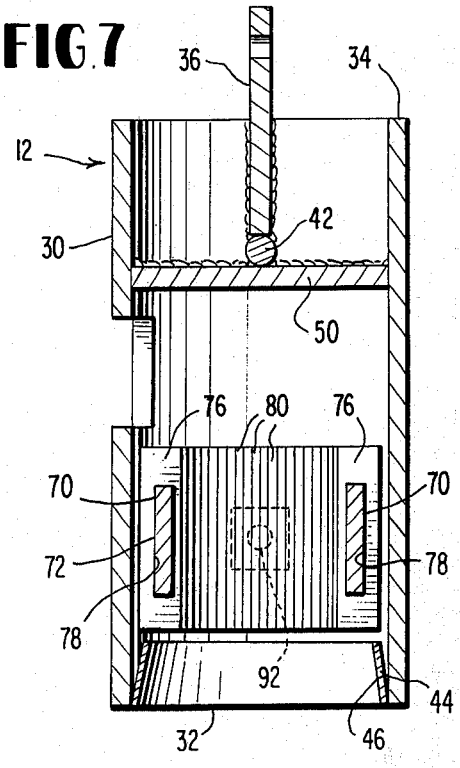
FIG. 7 is a cross-sectional view taken generally along lines 7—7 of FIG. 3.

To further secure and stabilize the coupling plate 36 to the casing and to remove vibration during an operation, a stabilizer shaft 42 is secured across casing 30 in a diametrical plane immediately below coupling plate 36 and the two pieces are welded together as shown in FIGS. 4 and 7.

In order to facilitate initial receipt of pile 10 in clamp head 12 in approximate centered position along the axis of casing 30, a centering cone, in the form of a steel ring 44, is fixed in lower open end 32 of casing 30. The internal angular surface 46 of ring 44 is tapered upwardly and inwardly to guide pile 10 along the axis of the casing into proper position.

To limit the extent of travel of clamp head casing 30 on the pile during initial placement on the pile to facilitate proper positioning of the pile in the casing, a stop member shown as a circular plate 50 is fixed across the top portion of the casing 30 below stabilizing shaft 42. Stop plate 50, which is also made from plate steel one and one-half inches thick, extends completely across casing 30 to close the casing passage at that point; it being understood that the stop plate is welded continuously around its periphery to casing 30.

GRIPPING SHOES 60 and 62

Gripping of the pile 10 in the casing 30 is achieved by a pair of clamping or gripping jaws or shoes 60, 62. One shoe 62 is fixed to one internal side of the casing such as by welding, however and although not shown, in another embodiment of the invention, the internal casing surface may be used as a fixed shoe in which case shoe 62 need not be formed separately and welded to the casing. However, it is preferred that shoe 62 be formed separately from the casing and secured thereto as shown.

Figure 6:
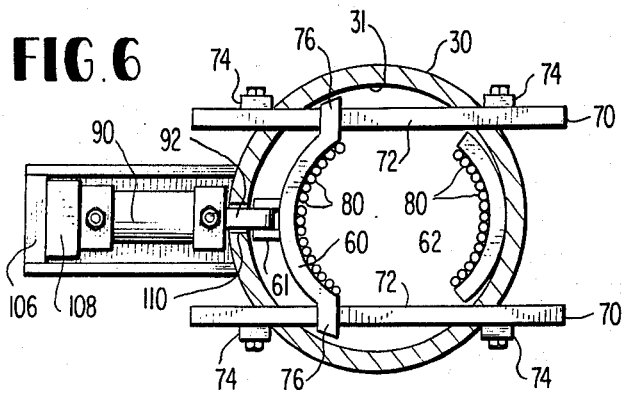
FIG. 6 is a cross-sectional view taken generally along lines 6—6 of FIG. 3.

The other gripping shoe 60 is movable across the casing towards and away from fixed shoe 62; it being understood from the drawings that shoes 60 and 62 are in diametrically opposed locations in casing 30. To properly position and guide shoe 60 in its movement towards and away from fixed shoe 62, a pair of guide and anchor members shown as bars 70 are fixed across the casing 30 in chordal positions. Bars 70 extend transversely through the interior of the casing 30 and are spaced along their intermediate portions 72 from adjacent portions 31 of the casing 30 as shown in FIG. 6. Anchor bars 70 in the preferred embodiment are made from steel plates thirty-eight inches long, eight inches wide and one and one-half inches thick. Furthermore, anchor bars 70 are secured to the casing by being received in aligned apertures in casing 30 and removably secured therein by stops 74 removably received in the opposite ends of anchor bars 70 as shown in FIG. 6.

Movable shoe 60 is mounted on anchor bar 70 for slidable movement by flanges 76 projecting on opposite sides of shoe 60 and having apertures 78 receiving bars 70. Apertures 78 are rectangular in shape to correspond to the rectangular cross section of anchor bars 70 in the specific embodiment shown. In addition to guiding movable shoe 60, anchor bars 70 also importantly serve to transmit forces imposed by the gripped pile from the shoes 60, 62 to the steel clamping casing.

In order to conform to the configuration of the piles, gripping shoes 60, 62 are shaped to correspond to the pile surface. When wood piles are to be removed, gripping shoes 60 and 62 are preferably formed with concave shapes as shown in FIG. 6. However, when concrete piles are to be removed, the shoes will preferably have a flat gripping surface (not shown). Also, in the preferred embodiment for removing wood piles, the pile engaging surfaces of gripping shoes 60, 62 are roughened or corrugated to enhance gripping action. In one preferred embodiment, this is achieved by steel or other alloy bars 80 welded to the gripping surfaces of shoes 60, 62. The size and configuration of the contact faces of gripping shoes 60 and 62 will, of course, depend on the size and configuration of the piles. In one specific embodiment used for eighteen inch diameter wood piles, shoes 60 and 62 are eighteen inches long, four inches thick and have a radius of curvature of approximately nine inches. When dealing with concrete piles, the gripping shoes preferably are made with a length of approximately four feet and with flat gripping surfaces without corrugations as employed in the gripping shoes 60, 62 for wood piles.

ACTUATION OF MOVABLE SHOE 60

Movable shoe 60 is pwoer-actuated by any suitable motor, preferably a hydraulic motor or jack 90 having a reciprocable piston and rod 92 connected by a pin 94 to a projecting back portion or ear 61 of movable shoe 60 as shown in FIGS. 4 and 6. Supply and exhaust of hydraulic or other motive fluid, to and from motor 90, is achieved by hoses 96 and 98 connected to a portable supply source generally designated 100. In an alternative embodiment, not shown, the hydraulic supply source for motor 90 may be provided by the same source (not shown) used for vibrating hammer 16 in those instances where the vibrating hammer is also hydraulically powered. In addition, and although not shown, an electric motor or other power means may be used in place of fluid motor 90 to reciprocate movable shoe 60.

In order to support motor 90 on casing 30 of the clamp head behind movable shoe 60, a support ledge in the form of a steel plate 102 with upstanding side walls 104 and rear end wall 106 is fixed by the casing by welding and further reinforced by a vertical gusset plate 107 extending between ledge 102 and casing 30. A removable spacer block 108 is provided between the rear end of motor 90 and end wall 106 to secure motor 90 in place against movement with the front end of the cylinder of motor 90 engaged against casing 30. To accommodate piston rod 92 of motor 90, casing 30 is provided with an aperture 110 receiving piston rod 92.

Although, not shown, casing 30 may be provided with a plurality of apertures 110 at different levels along the length of casing 30 for purposes of either relocating the movable clamping shoe 60 or for adding additional movable clamping shoes. While additional pairs of gripping shoes may be employed as just indicated, a single pair of clamping shoes 60, 62 as shown has been found to be satisfactory. Relocation of the single pair of clamping shoes 60 and 62 along the length of the casing may be desired in instances where the pile has rotted or become weakened and it is necessary to find a strong portion of the pile to be gripped by the clamping shoes 60 and 62; it being understood that clamping shoes 60 and 62 grip the pile with intense pressure. In the event it is desired to provide a plurality of casing apertures 110 along a long length of casing 30, the casing length, of course, may be increased. In addition, and although not shown, a plurality of motor-supporting ledges 102 may be fixed along the casing length to removably receive motor 90.

In order to remove movable shoe 60 for replacement or changing its position; stops 74 are removed from anchor bars 70 which may then be withdrawn through the apertures in casing 30. Pin 94 may then be removed from piston rod 92 of motor 90 and the ear 61 on the back of movable shoe 60. Movable gripping shoe 60 may then be withdrawn from the bottom open end 32 of casing 30.

Although not necessary, it is preferred that the casing 30 be provided with a window or opening 120 to provide visual or hand access into the interior of the casing.

OPERATION

Summarizing the operation of removing piles in accordance with the present invention, clamp head 12 is first secured to the bottom of vibrating hammer 16 by moving the jaws 40 of vibrating hammer 16 into firm engagement with the opposite sides of coupling plate 16 projecting from the top of clamp head 12. At this point in time or prior thereto, the interior of clamp head 12 is checked to make sure that movable gripping shoe 60 is in fully retracted position away from fixed gripping shoe 62 to provide sufficient space for receiving the pile to be loosened. If this condition does not exist, motor 90 is actuated in the proper direction to fully retract movable gripping shoe 60 away from fixed shoe 62. If not already in proper position, crane 18 may be moved into proper position so as to suspend cable 20 and its attached vibrating hammer and clamp head assembly directly over the pile to be removed. The crane operator then lowers crane cable 20 to lower clamp head 12 onto the pile with the pile passing between gripping shoes 60 and 62 until the top of the pile engages stop plate 50 in the upper portion of clamp head 12. Such engagement, of course, indicates that the gripping shoes 60 and 62 have passed sufficiently below the top surface of the pile and are ready now to grip opposite sides of the pile.

Hydraulic motor 90 is then actuated such as by any conventional means, for example, a control valve associated with portable power source 100 to extend movable gripping shoe 60 toward fixed gripping shoe 62 to firmly engage the opposite sides of the pile. A suitable pressure gauge associated with the motor or its power source may be used to indicate to the operator when sufficient gripping pressure has been applied to the pile. Such a pressure gauge, together with the hydraulic circuit and control valve are conventional and therefore do not require any further description.

The pile is now ready to be loosened, and thus vibrating hammer 16 is energized causing clamp head 12, together with pile 10 (which is fixed thereto as a unit by virtue of the intense clamping pressure of shoes 60 and 62) to move up and down and be loosened. After the pile is loosened, the crane operator may raise cable 20 to entirely remove the pile from its former embedded location. As an alternative method of removal to be used in large projects requiring removal of many piles from the same area, the clamp head 12 may be removed from the pile after it is loosened and then the pile is fully withdrawn and disposed of by another crane which follows with a conventional choker clamp which is attached to the loosened pile and then raised by the crane cable to remove the pile. During the latter removal operation, clamping head 12 and the associated vibrating hammer 16 suspended from the first crane are moved to the next pile for loosening the same.

In actual practice, the above-described invention has been found to be highly effective in removing wood piles eighteen inches in diameter and approximately seventy feet in length. Also, the present invention will successfully remove piles deeply embedded in marl material which holds the pile with exceedingly great force. The present invention provides a novel method of applying up and down vertical forces to the pile to loosen the same as opposed to merely an upward force as done by prior art methods. In addition, the present invention provides novel method and apparatus for attaching a heavy vibrating device to a pile so that the vibrating device moves together with the pile as a single unit to thus ensure that the vibration will be effective to loosen the pile. In addition, it will be seen that the present invention provides a novel clamp head which may be manufactured on a commercially feasible basis with available materials and which will dependably operate over long periods of repeated and rugged use even though subjected to the vibrations of the heavy vibrating hammer 16.

Although certain specific dimensions, materials and parts have been described above in order to illustrate and explain the present invention and the best mode presently known of carrying it out for a certain pile size, it should be understood that the intended scope of the present invention is defined in the appended claims.

What is claimed is:

1. A clamp head for gripping solid wood or concrete construction piles comprising in combination; a casing having a hollow lower portion for receiving piles with the casing surrounding the pile, a pair of opposed gripping shoes in the casing for receiving a pile therebetween and gripping opposite sides thereof, the pile contacting surfaces of the gripping shoes being shaped to correspond to the contour of the pile to be gripped, means including a motor mounted to the casing for moving at least one of said gripping shoes towards and away from the other gripping shoe for gripping and releasing a pile therebetween, mounting means in the casing receiving said one gripping shoe for maintaining and guiding said one gripping shoe for movement in a horizontal plane across the casing towards and away from the other gripping shoe, coupling means on the casing for releasably securing to the casing a device for imparting movement to the pile through the clamp head when a pile is gripped by said shoes, and a stop member fixed in the casing above the shoes for limiting the uppermost position of a pile in the casing.

2. The clamp head defined in claim 1 wherein said mounting means includes at least one anchor member fixed to the casing and extending across the interior of the casing, said movable shoe being mounted on said anchor member and movable along said anchor member towards and away from the other gripping shoe.

3. The clamp head defined in claim 2 wherein the casing has a pair of opposed apertures in opposite side portions thereof and said anchor member is received in both of said apertures.

4. The clamp head defined in claim 3 wherein said anchor member has at least one removable stop means on one end portion thereof for engaging said casing to prevent withdrawal of said anchor member from said apertures in the casing.

5. The clamp head defined in claim 4 wherein said anchor member has another removable stop means mounted on the opposite end portion thereof for engaging said casing to prevent withdrawal of said anchor member from said apertures in the casing.

6. The clamp head defined in claim 2 wherein the casing has a lower open end to axially receive a pile and wherein there is further included a centering means in said lower end of the casing for centering the pile as it enters the casing, said centering means including a conical ring fixed to inner portions of said casing at said lower open end.

7. The clamp head defined in claim 1 wherein said gripping shoes have generally concave pile-contacting faces for engaging cylindrical wood piles.

8. The clamp head defined in claim 7 wherein said concave pile contacting faces of the shoes have vertical ridges formed thereon running in the longitudinal direction of the shoes to enhance gripping action on the pile.

9. The clamp head defined in claim 1 wherein said gripping shoes have a length measured along the casing of approximately one and one-half feet.

10. The clamp head defined in claim 9 wherein said gripping shoes have a thickness of approximately four inches and are made from steel.

11. The clamp head defined in claim 8 wherein said ridges are formed by a plurality of metallic bars fixed to the pile-contacting faces of the shoes.

12. The clamp head defined in claim 1 wherein said coupling means includes a steel coupling plate fixed to the casing and projecting from the top thereof, said coupling plate having opposite faces for receiving the jaws of a vibrating hammer.

13. The clamp head defined in claim 12 wherein the upper end of said casing is hollow and said coupling plate extends in the upper end of said casing and is fixed along its opposite sides to said casing and wherein there is further included a stabilizing shaft extending across said casing in the upper end portion thereof and wherein said coupling member is fixed to said stabilizing shaft, and wherein said stop member is located below said stabilizing shaft.

14. The clamp head defined in claim 1 further including means for removably mounting said motor to the exterior of the casing adjacent said one gripping shoe.

15. The clamp head defined in claim 14 wherein there is further included a releasable connection means between the motor and said one gripping shoe for disconnecting the motor from said one shoe.

16. A clamp head for gripping wood or concrete construction piles having circular or polygonal cross section, the clamp head including a casing having a hollow lower portion including a lower open end for receiving piles with the casing surrounding the pile and extending a substantial distance along the top portion of the pile, a pair of opposed gripping shoes in the casing for receiving a pile therebetween and gripping opposite sides thereof, the pile contacting surfaces of the gripping shoes being shaped to correspond to the contour of the pile to be gripped, drive means for moving at least one of said gripping shoes towards and away from the other gripping shoe in a generally horizontal plane in the transverse direction of the casing for gripping or releasing a pile therebetween, a pair of anchor members fixed to and extending across the casing in laterally spaced positions relative to each other, said one shoe having opposite side portions received on and constrained by said anchor members while being slidable along said anchor members towards and away from the other shoe, the anchor members also serving to transmit forces to the casing from the pile being gripped.

17. The clamp head defined in claim 16 wherein said drive means includes a reciprocable fluid motor and wherein said casing includes means removably mounting said motor to the exterior of the casing, and wherein said shoes have a generally concave cross section corresponding to the shape of cylindrical piles to be gripped thereby.

* * * * *